United States Patent [19]

Meggs

[11] Patent Number: 4,690,403

[45] Date of Patent: Sep. 1, 1987

[54] BASES FOR THE GAME OF BASEBALL

[76] Inventor: Dennis Meggs, 285 Bluevale St., Unit #4, Waterloo, Ontario N2J 4L8, Canada

[21] Appl. No.: 813,573

[22] Filed: Dec. 26, 1985

[30] Foreign Application Priority Data

Dec. 31, 1984 [GB] United Kingdom ..... 8432786

[51] Int. Cl.[4] ..... A63B 71/00

[52] U.S. Cl. ..... 273/25; 273/DIG. 8

[58] Field of Search ..... 273/25

[56] References Cited

U.S. PATENT DOCUMENTS

| | | | |
|---|---|---|---|
| 2,156,469 | 5/1939 | Boltz | 273/25 |
| 3,508,747 | 4/1970 | Orsatti | 273/25 |
| 3,862,756 | 1/1975 | Selliken | 273/25 |
| 4,162,789 | 7/1979 | Holloway | 273/25 |
| 4,266,768 | 5/1981 | Hall | 273/25 |
| 4,531,733 | 7/1985 | Hall | 273/25 |

*Primary Examiner*—Richard C. Pinkham
*Assistant Examiner*—T. Brown
*Attorney, Agent, or Firm*—Sim & McBurney

[57] ABSTRACT

A baseball base incorporates an anchor defining a top surface and post or the like for inserting into the ground to secure the anchor in place, and a baseball base which has a ferromagnetic plate secured to the underside. The anchor incorporates a plurality of parallel, spaced elongate bands which constitute alternating north and south magnetic poles, so that the plate and baseball base can be secured and retained in place on the poles. By changing the size of the plate, the force required to separate the base from the anchor can be altered.

10 Claims, 5 Drawing Figures

BASES FOR THE GAME OF BASEBALL

This invention relates generally to improvements in the construction of bases for the game of baseball, softball and the like.

BACKGROUND OF THIS INVENTION

In the very popular games of baseball and softball, bases are used to mark three of the four corners of the baseball diamond around which the batter must run after hitting the ball. These are known as first, second and third base. Conventionally, the bases are made from canvas material with foam or other soft filling. Typically, the bases are held in position by steel pegs which are driven into the ground and then strapped to the bases.

Unfortunately, the game is such that a runner will often attempt to slide into the base in order to avoid being tagged by the baseman. Often, what happens is that the sliding player comes into contact with the steel peg, resulting in injury. These injuries occur at every level of play and in every age group, particularly with the increasing popularity of slow-pitch baseball.

The types of injuries that occur range from mere bruises to cuts, torn ligaments or muscles, and more commonly to compound fractures of the legs, ankles and feet. These types of injuries often have crippling effects on the victim which last the rest of his life.

One attempt to remedy this kind of problem is exemplified in U.S. Pat. No. 3,862,756, issued Jan. 28, 1975 to C.J. Selliken. The Selliken device incorporates a first member with a top plate and means for anchoring the top plate in base position with the upper surface of the top plate substantially flush with the ground, along with a second member resembling a baseball base, the second member having a bottom surface arranged to overlie the upper surface of the first member in its installed base position. Selliken then provides magnetic holding means in the upper surface of the first member and the bottom surface of the second member, the magnetic means holding the members together but allowing them to separate under unusual force conditions. More specifically, Selliken provides four individual magnets at the four corners of the base, these being adapted to interact with ferromagnetic means.

What is lacking in Selliken is any means by which to vary the force with which the base is held in place. It will be appreciated that the "separation force" required for big league hardball is quite different from that required in a children's softball game.

GENERAL DESCRIPTION OF THIS INVENTION

It is an aim of one aspect of this invention to provide a baseball base construction, utilizing magnetic holding force between the base and an anchoring means, such that the degree of lateral force required to dislodge the base can be quickly, easily and reliably changed.

More particularly, this invention provides a baseball base, comprising:

an anchor member having an upper portion with a top surface, and a lower portion adapted to be received in the ground to secure the anchor member in place the upper portion having magnetic means defining at the top surface a plurality of parallel, spaced, elongate bands which constitute alternating north and south magnetic poles, and an upper member having a top portion of a size and shape corresponding to that of the usual baseball base, and a ferromagnetic plate secured to the underside of said top portion, the plate being adapted to be retained in place on said alternating north and south magnetic poles.

GENERAL DESCRIPTION OF THE DRAWINGS

Two embodiments of this invention are illustrated in the accompanying drawings, in which like numerals denote like parts throughout the several views, and in which.

DETAILED DESCRIPTION OF THE DRAWINGS

Figure 1:
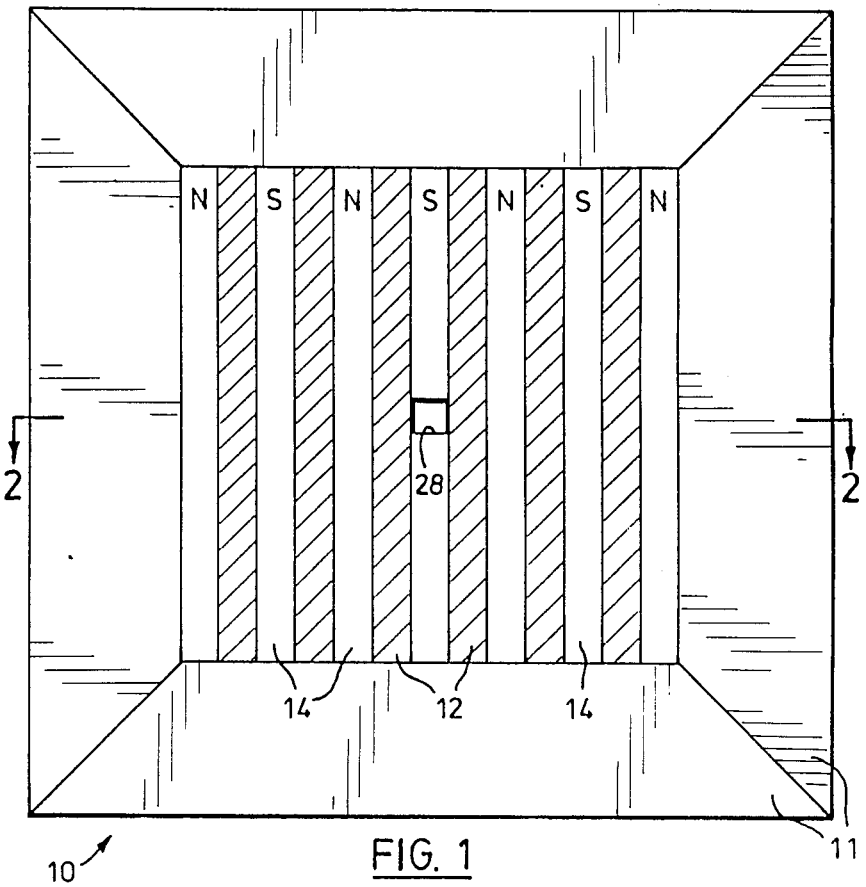
FIG. 1 is a plan view of an anchor member for use in this invention.

FIG. 1 shows in plan view the upper portion 10 of an anchor member intended to be installed underneath the position of the base. The upper portion 10 sits flush on the ground with the top surface raised above the ground surface, and has 30° beveled edges 11 so that a sliding player will slide over the portion 10.

The portion 10 is generally square in plan, and the edges 11 present only smooth corners that will not catch a sliding player or his clothing.

Figure 2:
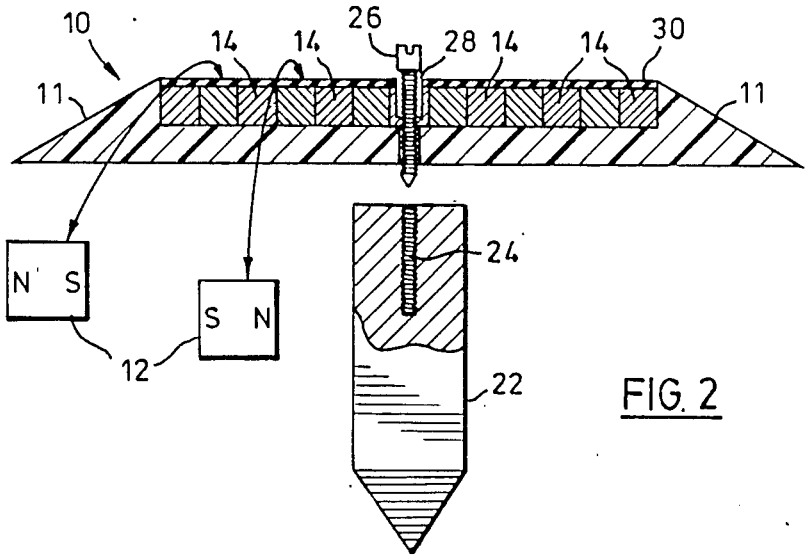
FIG. 2 is an axial sectional view of the anchor member of FIG. 1, taken at the line 2—2 in FIG. 1.

Internally of the upper portion 10 are located elongated, cross-magnetized ceramic magnetic bars 12 which are oriented with the north-south direction running horizontally as pictured in FIG. 2. For example, the furthest left bar in FIG. 2 has the south pole to the right and the north to the left, whereas the next rightward bar is arranged oppositely, i.e. with south to the left and north to the right. The remaining ceramic magnetic bars 12 continue to alternate in a similar fashion. Interposed between adjacent pairs of ceramic bars 12 are ferromagnetic bars 14, for example made of steel. It will thus be appreciated that each ferromagnetic bar 14 is sandwiched between two identical poles. Thus, where the poles are south poles, the ferromagnetic bar 14 would itself become a south pole. The next adjacent ferromagnetic pole would likewise be a north pole. This would mean that magnetic flux lines between the adjacent ferromagnetic poles (north and south) would seek a convenient path.

Figure 3:
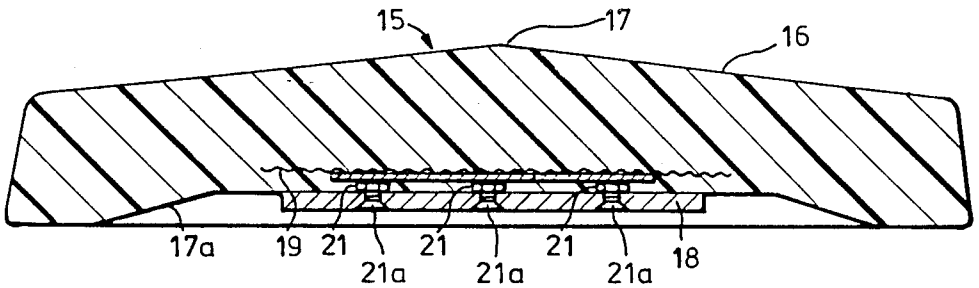
FIG. 3 is a sectional view through an upper member in the form of a baseball base for use in this invention to cooperate with the anchor member of FIG. 1.

In FIG. 3 is shown an upper member 15 which includes a top portion 16 of a size and shape corresponding to that of the usual baseball base, which is slightly crowned as shown at 17. The top portion 16 has a rectangular bottom recess 17*a*, in which a ferromagnetic plate 18, for example of steel, is secured. Internally, the portion 16, preferably molded of foamed urethane, has a piece 19 of expanded metal to which is welded a metal bar 20 having nuts 21 in turn welded to it. Bolts 21*a* secure the plate 18 in place. The plate 18 acts, in effect, as a "keeper" for the magnetic complex which includes the magnets 12 and the ferromagnetic bars 14 buried in the upper portion 10 of the anchor member.

Cooperating with the upper portion 10 of the anchor member is a lower portion in the form of a ground sleeve 22 intended to be driven or buried in the ground. The sleeve 22 has a tapped central bore 24 which receives a retaining screw 26 passing through a central opening 28 in the upper portion 10, thereby to secure the upper portion 10 in place.

In the embodiment shown in FIG. 2, a layer of rubber 30 or other high-friction material may be laid over the magnets 12 and the ferromagnetic bars 14, in order to provide protection for the magnetic structure and also a frictional grip against the ferromagnetic plate 18 secured to the top portion 16 of the upper member. Altertnatively, the ferromagnetic bars 14 may terminate flush with the top of the upper portion 10, with the magnets 12 slightly recessed below the bars, and covered with rubber or other high-friction material.

Figure 4:
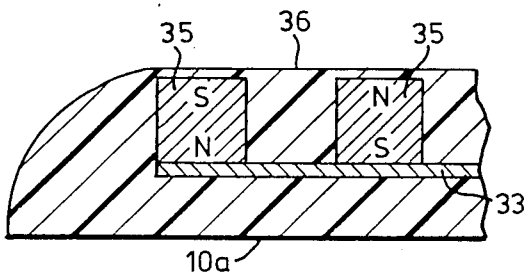
FIG. 4 is a partial sectional view through an alternative embodiment of the anchor member.

In an alternative embodiment shown in FIG. 4, the upper portion 10*a* is of molded rubber, and contains a ferromagnetic plate 33 upon which spaced magnetic ceramic bars 35 are located. The bars 35 are slightly recessed below the top 36 of the rubber, and thus are protected. The rubber extends down between the spaced magnetic bars 35. The magnetic structure shown in FIG. 4 operates somewhat on the principle of a potted magnet, in that adjacent magnets are reversed. As can be seen in FIG. 4, the left hand magnet has the south pole to the top, whereas the next rightward magnet has the north pole to the top. Thus the flux lines can flow from the bottom north and south poles along the ferromagnetic plate 33, but at the top they seek another path to complete the magnetic circuit. This path is of course provided by the ferromagnetic plate 18 under the top portion 16 of the upper member. The structure shown in FIG. 4 has the advantage of securely anchoring the top layer of rubber, due to the fact that the rubber extends fully down between the magnets (in the place of the ferromagnetic bars 14 of the FIG. 2 embodiment).

It should be understood that the upper portion 10 of the anchor member could be made from other hard and smooth materials, such as epoxy, or a non-magnetic metal such as aluminum.

For a given baseball installation, a plurality of ground sleeves 22 could be installed at the various locations where bases are to be positioned. Since different levels of play require different base positions, the insertion of ground sleeves in all of these locations could be arranged before the season starts. This will allow the purchaser to install the base without measuring before each game. The ground sleeve is designed to lock the base into place so that it cannot move during the process of a game. The ground sleeves 22 may be provided with special caps (not shown) to allow for easy assembly and easy maintenance.

As an alternative to the molded and foamed plastic structure shown in FIG. 3, it will be appreciated that the top portion 16 of the upper member 10 can simply be a bag of the same size. shape and dimension as a standard base. Alternatively, it could be made from a very tough, cut-resistant ballistic nylon, capable of taking the stress that will arise in the break-away baseball-/softball bags. The base material can be dyed an acceptable colour.

For the construction of the top portion 16 shown in FIG. 3, the plastic can be molded in such a way as to provide a higher density adjacent the outer surface thereof, and a lower density internally. The higher density skin would provide high wear-resistance. It is preferred, for the latter embodiment, that the upper surface of the top portion 16 be ribbed over its entire extent, because this thickens the high-density skin, and improves wear-resistance even further.

Turning now to the ferromagnetic plate 18, it will be understood that this may be of steel, or any other suitable magnetic material capable of being attracted with sufficient force against the top of the upper portion 10 of the anchor member. It is contemplated in this invention to allow for variation of the magnetic bond between the anchor member and the upper member, by providing a plurality of plates 18 of different sizes, the plates being easily and quickly interchangeable. It will be appreciated that the larger the plate 18, the harder it will be to dislodge the upper portion 16 from the portion 10.

It has been found that sufficient magnetic force can be generated to keep the portion 16 from moving off the portion 10 when a player is simply running on the bases. It is believed that this is due to the fact that when a player is running the bases and steps on the magnetically retained base, most of the force is exerted downwardly, thus urging the portion 16 more strongly in place against the upper portion 10 of the anchor member, and contributing to the retention of the member 16 in place. However, when a player slides into the portion 16 with sufficient weight and speed, the needed force can be generated to shear the portion 16 off the portion 10 of the anchor member, thus eliminating the possibility of injury. After the bag portion 16 has slid away, it can easily be placed back into position without loss of play or disruption of the game. It will be understood that a plurality of plates of different sizes would be provided, to allow for the variation in the force by which the portion 16 is held against the portion 10.

It is further important to understand that the portion 10 itself can function as a baseball or softball base even though the actual top portion 16 (the baseball base) may have been moved off the portion 10 under the impact of the sliding player. Thus, the player does not have to go with the moving bag or top portion 16, but has the "secondary bag" (the portion 10) to tag to.

Figure 5:
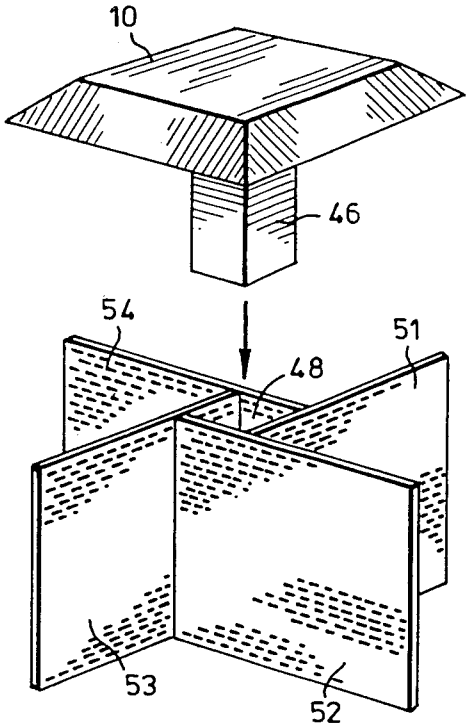
FIG. 5 shows a variant of the means for securing the anchor member to the ground.

Referring to FIG. 5, there is shown a variation in the manner in which the upper portion 10 is secured to the ground. In the variation shown in FIG. 5, the upper portion 10 has affixed thereto a central, vertically extending post 46, which is receivable in a vertical recess 48 defined between four welded-together pieces of expanded metal 51, 52, 53 and 54. The unit comprising the pieces 51–54 is buried in the ground at the desired location, with the recess 48 being kept clear. When the upper portion 10 of the anchor means is not in place, a plug or stopper can be provided to fill the recess 48 and prevent the ingress of dirt, etc.

Referring to FIG. 1, it will be appreciated that the magnets 12 do not need to extend fully across the portion 10. In one satisfactory arrangement, the amount of magentic material in the inner columns is less than the amount of magnetic material in the outer columns. It is contemplated to simply adjust the amount of magnetic material to the point or it provides a satisfactory retentive holding action.

While two embodiments of this invention have been illustrated in the accompanying drawings and described hereinabove, it will be evident to those skilled in the art that changes and modifications may be made therein, without departing from the essence of this invention.

The embodiments of the invention in which an exclusive property or privilege is claimed are defined as follows:

1. A baseball base, comprising:

an anchor member having an upper portion with a top surface, and a lower portion adapted to be received in the ground to secure the anchor member in place, the upper portion having magnetic means defining at the top surface at least four parallel, spaced, elongate bands which constitute alternating north and south magnetic poles, and an upper member having a top portion of a size and shape corresponding to that of the usual baseball base, and a ferromagnetic plate secured to the underside of said top portion, the plate being adapted to be retained in place on said alternating north and south magnetic poles.

2. The invention claimed in claim 1, further including releasable means securing the plate to the top portion, and at least one further plate of different size from the first-mentioned plate, whereby the further plate can be exchanged for said first-mentioned plate.

3. The invention claimed in claim 1, in which said bands comprise parallel, spaced elongate bars of ferromagnetic material, and between each adjacent pair of bars a magnetic insert polarized such that magnetic flux lines within each insert are perpendicular to the long direction of the elongate bars and parallel with said top surface, the north-to-south direction in an insert on one side of a bar being opposed to the north-to-south direction in an insert on the other side of the same bar, whereby the latter bar becomes the equivalent of a magnetic pole.

4. The invention claimed in claim 3, further including releasable means securing the plate to the top portion, said plate being one of a plurality of interchangeable plates of different sizes.

5. The invention claimed in claim 1, in which said magnetic means comprises at least three parallel, spaced elongate magnets arranged such that magnetic flux lines within each magnet are perpendicular to the long direction of the magnets and perpendicular to said top surface, the north-to-south direction in each magnet being opposite the north-to-south direction of an immediately adjacent magnet, and in which there is provided a ferromagnetic plate below and substantially in contact with all said magnets.

6. The invention claimed in claim 5, further including releasable means securing the plate to the top portion, said plate being one of a plurality of interchangeable plates of different sizes.

7. The invention claimed in claim 1, in which said lower portion of the anchor member is in the form of a post adapted to be driven into the ground, and means are provided for removably securing said upper portion to said anchor member.

8. The invention claimed in claim 1, in which said lower portion of the anchor member is made from expanded metal and defines a vertical recess, the upper portion having affixed thereto a post adapted to be received in said recess.

9. The invention claimed in claim 1, in which said top portion of the upper member is made of urethane with a denser region adjacent the surface thereof and a less dense region internally of the top portion, the latter having a piece of expanded metal centrally within it, said piece having secured thereto portions defining threaded bores, and a plurality of fastening members engaging said bores and fastening said ferromagnetic plate to the underside of said top portion.

10. The invention claimed in claim 1, in which the top portion of the upper member has a bottom wall defining an upward, central recess into which the upper portion of the anchor member can be received.

* * * * *